United States Patent [19]

Minami

[11] 4,006,908

[45] Feb. 8, 1977

[54] PRACTICE GOLF BALL

[75] Inventor: Tieko Minami, Tokyo, Japan

[73] Assignee: Yoichi Kawamura, Yokohama, Japan

[22] Filed: Apr. 13, 1976

[21] Appl. No.: 676,654

[30] Foreign Application Priority Data

Apr. 17, 1975 Japan ..... 49-52540

[52] U.S. Cl. ..... 273/183 C; 273/199 A; 273/58 D; 273/DIG. 20

[51] Int. Cl.[2] ..... A63B 69/36

[58] Field of Search ..... 273/58 R, 58 D, 58 E, 273/199 R, 199 A, 183 C, 200 R, 200 A, 200 B, 61 A, 26 R, 106 F, 232, DIG. 20

[56] References Cited

UNITED STATES PATENTS

| | | | |
|---|---|---|---|
| 927,499 | 7/1909 | Davis | 273/58 R |
| 1,483,165 | 2/1924 | Eaton | 273/199 R |
| 2,783,046 | 2/1957 | Lien | 273/58 R |
| 3,082,572 | 3/1963 | Knox | 273/106 F X |

*Primary Examiner*—George J. Marlo

[57] ABSTRACT

A spherical structure constituting a practice golf ball and integrally formed of a tough synthetic resin has a polar axis and has: a circular equatorial vane perpendicular to the polar axis; a tubular hub disposed coaxially around the polar axis; a plurality of meridian vanes of substantially semicircular shape joined at their chordal parts to the hub part and spaced at equal angular intervals; and a middle band engirdling the spherical structure around the circumference of the equatorial vane, the semicircular outer edges of the meridian vanes and the middle band forming the outer spherical contour of the practice golf ball.

5 Claims, 12 Drawing Figures

PRACTICE GOLF BALL

BACKGROUND OF THE INVENTION

This invention relates generally to practice balls for use in practicing golf strokes with balls and more particularly to an improved practice golf ball which, when stroked, flies through a short flight distance yet with a flight characteristic such as to indicate any error made by the practicing golfer.

For practicing golf strokes by actually hitting golf ball, golf practice ranges are ordinarily utilized. Alternatively, where an empty space of an area sufficient for free swinging of golf clubs is available, a net enclosure with only one open side is erected in that space and used for practice.

The latter method is convenient and inexpensive but can be utilized merely for swinging a golf club and striking a ball, and the character of the shot or the flight of the ball cannot be determined. For this reason, the practicing golfer goes through his practice without knowing whether or not he has made each shot correctly.

In contrast, a golfer practicing at an ideal golf practice range can see the character of each of his shots and therefore can carry out correct practice. However, in many golf practice ranges, particularly in urban areas, the distance from the teeing ground to the back net is shorter than (as short as ⅓ of) the maximum possible driver shot distance. Consequently, the actual distances hit cannot be determined and, moreover, slices and hooks, which become discernable only beyond this short distance, and their degrees of curvature cannot be observed. In such short ranges, therefore, the golfer cannot carry out fully effective practice. Accordingly, a golf practice range of great scale becomes necessary for effective practice, but such a golf practice range requires an enormous land area and a great expenditure. Actually, such a large practice range is impractical within most large cities or even suburbs thereof.

A solution to this problem could be achieved if the flight characteristics of a golf ball stroked in the regular manner could be indicated or determined in a short distance. For this purpose, a regular golf ball cannot be used, but the use of a ball of light weight and larger air resistance appears to be one possible solution. While known practice golf balls have been developed with this object in view, their greater object of making the energy of the ball in flight very small has been to prevent causing damage to surrounding objects and injury to nearby human beings and animals even when these balls are used for practice in small spaces. For example, a hollow spherical structure A made of a material such as felt and having a large number of holes 1 as shown in FIG. 1 is known. The flight distance of a ball of this kind, of course, cannot be compared with that of a regular golf ball hit with the same stroke, and, moreover, the direction of flight of a ball of this kind is unpredictable. When this ball is hit, the feel at impact is poor, and there is no sensation of solid impact, the only favorable feature of the ball being its safety.

Another example of a known practice ball as disclosed in Japanese Utility Model Publication No. 18022/1968 (Utility Model No. 864,925), entitled "Ball for ball-hitting practice", is illustrated in FIGS. 2, 3, and 4. This practice ball B comprises a plurality of ring-shaped sheets made of a synthetic resin which have been folded along diametric folding lines to form elements of Vee-shaped cross section with acute dihedral angle, and which have been so assembled and bonded together that their fold lines are brought together at a centerline. The resulting structure has a spherical shape. By suitably selecting the material of this practice ball, a ball which imparts a much better feel at impact than the ball illustrated in FIG. 1 and produces ample sensation of solid impact can be obtained. The flight distance, however, is excessively short, and, moreover, the line of flight is not stable.

SUMMARY OF THE INVENTION

It is an object of this invention to provide a practice golf ball which, when stroked in practice, undergoes a flight in a state approaching the flight state of a regular golf ball stroked in the same manner yet travels through a flight distance which is a fraction of that of the regular golf ball.

Another object of the invention is to provide a practice golf ball which, when struck, imparts an impact feel close to that of a regular golf ball.

Still another object of the invention is to provide a practice golf ball in the use of which, by selecting the stance line, the cause of an incorrect shot can be detected from a very small variation in the line of flight.

According to this invention, briefly summarized, there is provided a practice golf ball constituted and characterized by a spherical structure which is made of an elastic tough material and has a polar axis, and which has as integrally formed parts thereof: a circular equatorial vane lying in an equatorial plane perpendicular to the polar axis; a hub part disposed coaxially relative to the polar axis and extending between opposite outer sides of the spherical structure; a plurality of meridian vanes of substantially semicircular planar shape lying in respective meridian planes spaced at equal angular intervals and mutually intersecting at the polar axis, the meridian vanes being integrally joined at their chordal parts to the hub part; and a middle band of a specific width engirdling the spherical structure around the circumference of the equatorial vane, the semicircular outer edges of the meridian vanes and the middle band forming the outer spherical contour of the golf ball.

The nature, utility, and further features of this invention will be more clearly apparent from the following detailed description with respect to preferred embodiments of the invention when read in conjunction with the accompanying drawings, in which like parts are designated by like reference numerals and characters.

DETAILED DESCRIPTION OF THE INVENTION

Figure 1:
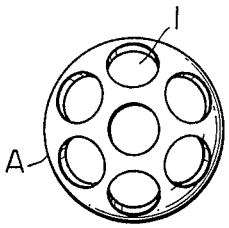
Fig. 1 PRIOR ART
FIG. 1 is a view showing one example of a practice golf ball known in the prior art.
Figure 2:
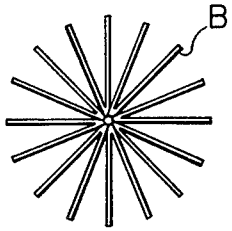
Fig. 2 PRIOR ART
FIGS. 2 and 3 are mutually orthogonal views showing another example of a known practice golf ball.
Figure 3:
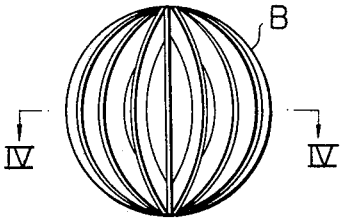
Fig. 3 PRIOR ART
Figure 4:
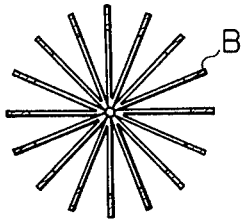
Fig. 4 PRIOR ART
FIG. 4 is a sectional view taken along the plane indicated by line IV—IV in FIG. 3.
Figure 5:
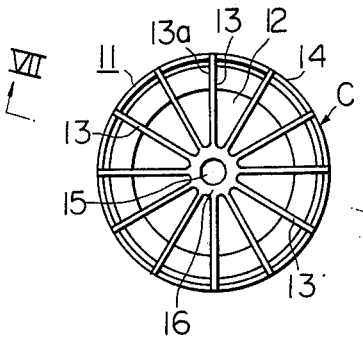
FIGS. 5 and 6 are mutually orthogonal views showing an example of the practice golf ball according to the invention.
Figure 6:
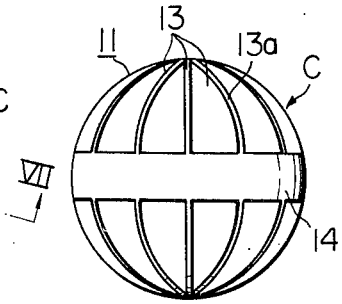
Figure 7:
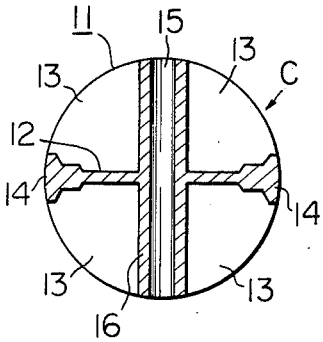
FIG. 7 is a sectional view taken along the plane indicated by line VII—VII in FIG. 5.

The practice ball C constituting a first embodiment of this invention and illustrated in FIGS. 5, 6, and 7 is made of a semihard synthetic resin of great toughness and is formed by injection molding. The spherical structure 11 of this ball C comprises an equatorial disc or vane 12 of circular shape extending through the center of the spherical structure in a plane bisecting the structure at its part corresponding to the equator, a plurality of meridian vanes 13 of semicircular planar shape lying in planes respectively passing through equally-spaced meridians and the polar axis of the spherical structure 11, a middle band 14 of a specific width passing around the structure 11 with the equator at the center thereof, and a tubular hub 16 which constitutes a hub which is coaxial with the polar axis, and with which the root or inner parts of all of the meridian vanes 13 are integrally formed. This hub 16 has a central hole 15 formed therethrough.

The outer peripheral edges 13*a* of the meridian vanes 13 and the outer surface of the middle band 14 form parts of the outer surface of the spherical structure 11. The parts enclosed by adjacent meridian vanes 13, the equatorial vane 12, and the middle band 14 assume the shape of Vee-shaped grooves with inner valley bottoms parallel to the polar axis of the spherical structure 11.

The state during use of the golf ball of the above described construction according to this invention is as follows.

Figure 8:
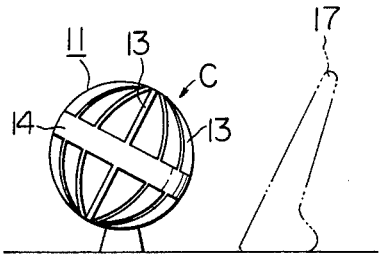
FIGS. 8 and 9 are elevations respectively showing states of use of the practice golf ball illustrated in FIGS. 5, 6, and 7.

First, as indicated in FIG. 8, the practice golf ball C is teed up with the polar axis of the spherical structure 11 parallel to the club face of the club 17 to be used thereby to match the polar axial direction with the loft of the club 17. Then, when the ball C is hit with the club 17, it is struck at the part of its middle band 14, and, depending on the imparting of a backspin or a topspin to the ball, a subtle variation is produced in the line of flight of the ball.

Figure 9:
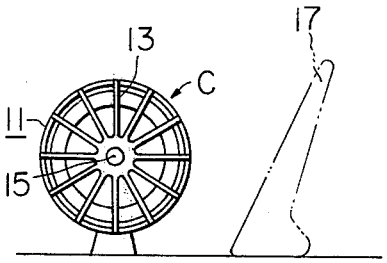

When the ball C is teed up with its polar axis parallel to the ground and perpendicular to the line of flight as indicated in FIG. 9 and hit with the club 17, the line of flight varies sensitively with respect to even a slight sidespin.

The former shot will be called an *x* shot, while the latter will be called a *y* shot. Then, in the case of an *x* shot, the flight direction is correct, and whether it was a pushed shot or whether it was a pulled shot can be amply detected. In the latter case of a *y* shot, since the ball flies in direction of an extension of the middle band 14, the directivity is slightly inferior to that in the case of an *x* shot.

It has been found as a result of experiments on the flight distances of *x* shots and *y* shots that the flight distance of a *y* shot was longer than that of an *x* shot by a distance of the order of 1 meter(m.). It was found that, with a driver, an *x* shot was 31 m., while a *y* shot was 32 m. With a spoon and number-3 iron, an *x* shot was also 31 m., while a *y* shot was 32 m. With a number-5 iron, an *x* shot was 27 m., while a *y* shot was 28 m. With a number 7 iron, an *x* shot was 24 m., while a *y* shot was 25 m. With a number-9 iron, an *x* shot was 22 m., while a *y* shot was 23 m.

Furthermore, the time during which the ball is in flight is from 3 to 4 seconds under windless conditions. Accordingly, after the impact, follow-through, and finish, there is ample time to observe carefully the flight of the ball.

It is a common belief that, when a correct shot has been made with a regular golf ball, that is, when no error has been made, this fact can be detected by the feel of the impact. However, in view of the fact that in contrast to a downswing duration of the order of 0.2 second, the impact duration is of the order of 0.0005 second, it is almost impossible for an ordinary human being of normal ability to interassociate the feel of the impact and the nature of his own shot during his swing, let alone even at the time of the finish. In the case where a shot is made with the practice ball of this invention, which stays in flight for 3 to 4 seconds, the golfer can observe the shot with ample time margin and, therefore, can easily interassociate the feel of the impact and the actual nature of the shot.

In this instance, the relatively short flight distance of the order of 25 to 35 m. facilitates discriminating analysis by visual observation.

Figure 10:
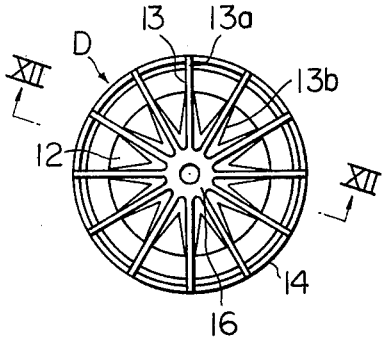
FIGS. 10 and 11 are mutually orthogonal views showing another example of the practice golf ball according to the invention.
Figure 11:
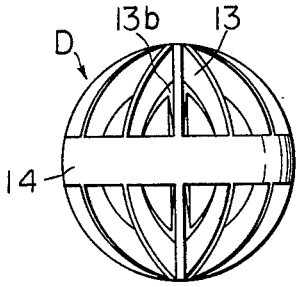
Figure 12:
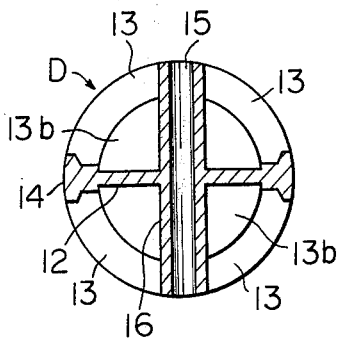
FIG. 12 is a sectional view taken along the plane indicated by line XII—XII in FIG. 10.

In a second embodiment of this invention as illustrated in FIGS. 10, 11, and 12, the ball D is generally of the same construction as the ball C in the first embodiment of the invention, having vanes 13, but differs from the ball C in that each meridian vane 13 is provided at its inner portion with a thickened part 13*b* for increasing the weight of the ball. By this structural feature, the weight of the ball can be increased by approximately 20 percent over that of the ball C of the first embodiment of the invention. As a result of this increase in weight, the flight distance is increased.

As will be apparent from the foregoing description, the practice golf ball according to this invention tends to acquire a great quantity of spin energy upon being struck at its meridian vanes 13 and middle band 14 by the club face of a golf club, whereby variations of the line of flight of the ball are magnified in an exaggerated manner, the flight inclination being exaggerated by a backspin.

Therefore, the practice golf ball of this invention is not a ball to be merely hit in practice as in the case of known practice balls but is a ball which flies in a state wherein even a slight error in stroking is magnified and rendered conspicuous. Thus the practice golf ball of the invention has a corrective function. This ball, moreover, is relatively light and safe, similarly as known hollow practice balls, and can be used without anxiety in places of relatively small area and short shot distance.

I claim:

1. A golf ball for practice constituted by a spherical structure having a polar axis and made of an elastic tough material, said spherical structure comprising, in integrally formed state: a circular equatorial vane lying in an equatorial plane perpendicular to the polar axis; a hub part disposed coaxially relative to the polar axis and extending between opposite outer sides of the spherical structure; a plurality of meridian vanes of substantially semicircular planar shape lying in respective meridian planes spaced at equal angular intervals and mutually intersecting at the polar axis, the meridian vanes being integrally joined at their chordal parts to the hub part; and a middle band of a specific width engirdling the spherical structure around the circumference of the equatorial vane, the semicircular outer edges of the meridian vanes and the middle band forming the outer spherical contour of the golf ball.

2. A golf ball for practice as claimed in claim 1 in which the spherical structure is made of a synthetic resin.

3. A golf ball for practice as claimed in claim 1 in which the hub part has a central hole coaxial with the polar axis.

4. A golf ball for practice as claimed in claim 1 in which the thickness of the inner part of each meridian vane in the vicinity of the center of the spherical structure is relatively greater than the thickness of the vane in the vicinity of the peripheral edge thereof.

5. A golf ball for practice as claimed in claim 1 in which the number of meridian vanes is twelve.

* * * * *